US006237820B1

(12) United States Patent
Saxton

(10) Patent No.: US 6,237,820 B1
(45) Date of Patent: May 29, 2001

(54) PERSONAL CARRIER

(76) Inventor: Ronald P. Saxton, 6754 Spaulding Rd., West Springfield, PA (US) 16443

( * ) Notice: Subject to any disclaimer, the term of this patent is extended or adjusted under 35 U.S.C. 154(b) by 0 days.

(21) Appl. No.: 09/339,392

(22) Filed: Jun. 23, 1999

(51) Int. Cl.[7] ..... A45F 3/16

(52) U.S. Cl. ..... 224/148.5; 224/191; 224/250; 224/581; 215/395; 220/737; D3/229

(58) Field of Search ..... 215/390, 393, 215/395; 224/148.5, 148.6, 148.7, 250, 148, 148.4, 581, 191, 195; 220/903, 592.16, 592.17, 592.23, 592.24, 694.1, 737, 739; D3/229; 235/487; 383/2; 493/186

(56) References Cited

U.S. PATENT DOCUMENTS

| | | | | |
|---|---|---|---|---|
| 184,153 | * | 11/1876 | Holton | 450/155 |
| D. 259,063 | * | 4/1981 | Manikas | D27/51 |
| D. 333,569 | * | 3/1993 | VanOrden | D3/105 |
| D. 371,725 | * | 7/1996 | Moreno | D7/624 |
| D. 376,956 | * | 12/1996 | Sharp | D7/607 |
| D. 376,957 | * | 12/1996 | Sharp | D7/607 |
| 731,378 | * | 6/1903 | Luther | 150/118 |
| 1,376,219 | * | 4/1921 | Munter | 450/121 |
| 1,395,485 | * | 11/1921 | Duncan et al. | 48/4 |
| 1,736,383 | * | 11/1929 | Waggoner | 150/184 |
| 2,520,343 | * | 8/1950 | Saum | 401/200 |
| 4,248,356 | * | 2/1981 | Christiansen | 224/148 |
| 5,169,025 | * | 12/1992 | Guo | 220/739 |

* cited by examiner

*Primary Examiner*—Stephen K. Cronin
(74) *Attorney, Agent, or Firm*—Richard K. Thomson

(57) ABSTRACT

A generally rectangular sheet which has a plurality of holes arranged in vertical and horizontal rows is secured into any of a variety of different sized sleeves. This may be accomplished by the use of a lace or strand being woven through overlying holes, by the use of two-piece rivets, or by the use of nubs extending from a first surface adjacent one edge of the sheet being received in holes adjacent the opposite edge. A bottom for the sleeve can be formed by interweaving the strand or by a separate bottom member that is attached by two-piece rivets or arms. These arms may be received in a horizontal row of holes directly or nubs on the arms may extend into the holes. The attachment nubs can be shaped to be received in complimentarily shaped holes in the sheet and may involve a sliding into a recess sized to receive a head portion of a button. An extending tab can be used to secure the personal carrier to a belt or shoulder strap to secure it to a portion of the body of the user. An additional sleeve can be added to the bottom of a first sleeve to accommodate a separate article or provide for an elongated item.

20 Claims, 6 Drawing Sheets

PERSONAL CARRIER

BACKGROUND AND SUMMARY OF THE INVENTION

The present invention is directed to the field of personal carriers. More particularly, this invention is directed to a personal carrier which can be reconfigured to support any of a variety of items.

Walkers, joggers, hikers, hunters and fishermen need a place to carry a squeeze bottle or other beverage container. In addition, workmen use a variety of ways to support tools such as hammers, caulking guns, spray guns, nail guns, paint rollers, spray cans, cleaning spray bottles, levels, squares and a variety of other items. Further, while they may wish to support a tool at a particular time, they may wish to support a beverage bottle or some different sized article at another time.

It is the purpose of the present invention to provide a personal carrier which can be configured to carry any of a number of different sized and shaped articles. The carrier comprises a generally rectangular sheet which is perforated by a first plurality of holes configured in a second plurality of vertical rows permitting said sheet to be wrapped into any one of a third plurality of different sized sleeves; attachment means extending through a fourth plurality of said holes to secure said sheet in said one of said third plurality of different sized sleeves; means to form a bottom of said one of said third plurality of different sized sleeves; and means to secure said sleeve to a body portion of a person. The sheet is preferably made of leather, plastic or canvas.

Attachment means may be a strand of plastic, nylon, cotton, leather or a blend thereof The generally rectangular sheet could be formed with integrally extending straps which can be looped through some of the first plurality of holes. Alternatively, the sheet can be formed with a plurality of integral nubs which are configured to fit within complimentarily shaped holes in the sheet to form any of a plurality of different sized sleeves. The nubs may be formed as buttons which fit into one leg of a figure-8 opening, the two legs being interconnected by a slot so that the button can be slid from a first of the figure-8 arms into the second which is recessed to allow the button to sit flush with the surface of the sleeve.

A variety of bottoms can be provided for the personal carrier of the present invention. The bottom may be constructed by weaving a second portion of the strand used to fasten the sheet into the sleeve back and forth across a common horizontal row of holes to create a bottom. Alternatively, a separate strap could be provided which can be secured to the sleeve using a two-piece rivet. Another possibility is the bottom element has a plurality of arms each with a plurality of nubs which can be inserted into the complimentarily shaped holes to form a closed end sleeve. An integral tab on the top edge of the generally rectangular sheet can be folded over and secured to form an opening to receive a belt or other strap used to secure the personal carrier to a portion of the user.

The device is flexible in its use and two sleeves can be connected to provide a larger carrier for longer items or the bottom omitted to permit the excess length to protrude if the item has an overhanging portion or fits snugly within the sleeve. The sleeve can be reconfigured to receive different sized articles for subsequent uses of the carrier.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
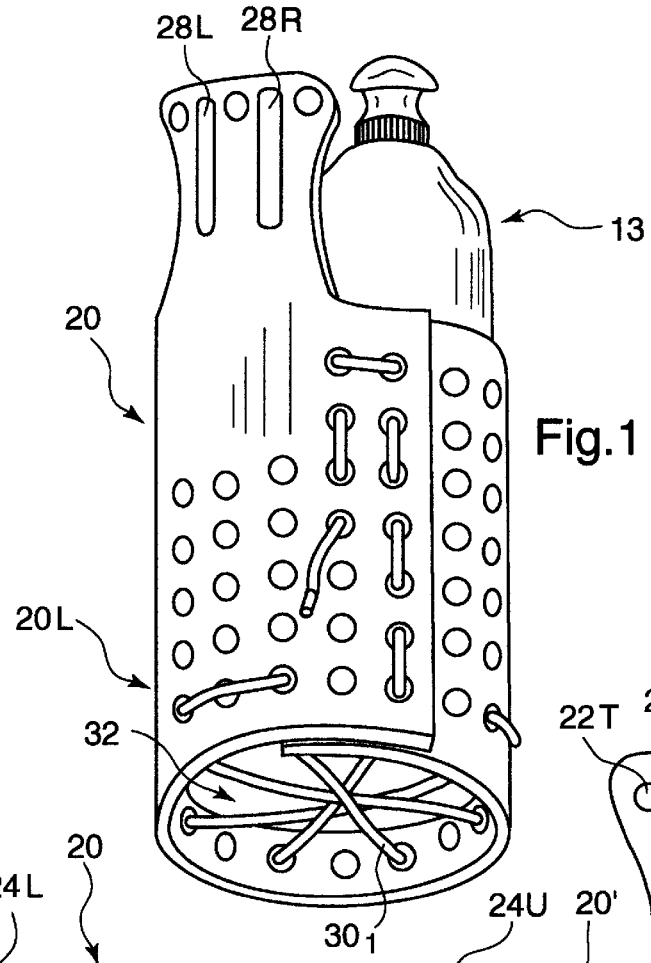
FIG. 1 is a perspective view of a first embodiment of the personal carrier of the present invention.
Figure 3:
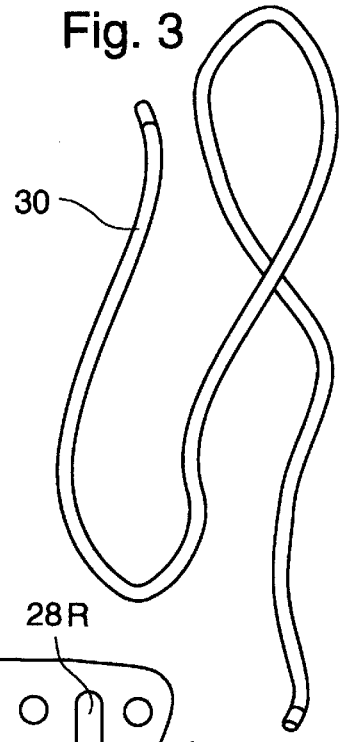
FIG. 3 is a plan view of the leather thong used to fasten the personal carrier into the desired shape.
Figure 2:
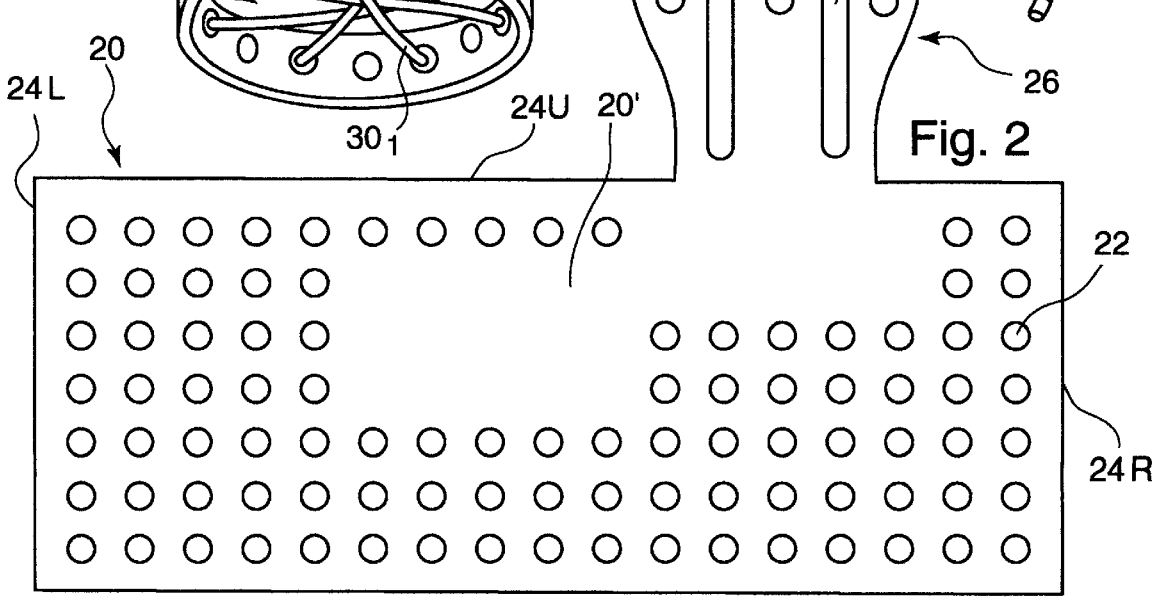
FIG. 2 is a plan view of the diecut sheet used to form the personal carrier of FIG. 1.

A first embodiment of the personal carrier of the present invention is depicted in FIG. 1 generally at 20. As seen in FIG. 2, personal carrier 20 is comprised of a generally rectangular sheet 20' which is perforated with a plurality of holes 22. Preferably, holes 22 are formed in a plurality of horizontal and vertical rows. By overlapping the two rows along right edge 24R over the appropriate number of rows extending parallel to left edge 24L, a sleeve 20 of the desired dimension can be formed. This configuration can be maintained by lacing a strand 30 through sets of overlying holes 22. Strand 30 may be a leather thong or a lace made of plastic, nylon, cotton or some hybrid of these materials (FIG. 3). The ends of strand 30 could be knotted but, more preferably, simply lacing strand 30 through holes 22 will provide adequate frictional resistance to the article 13 forcing the sheet 20' to open up into its flat alignment.

Figure 14:
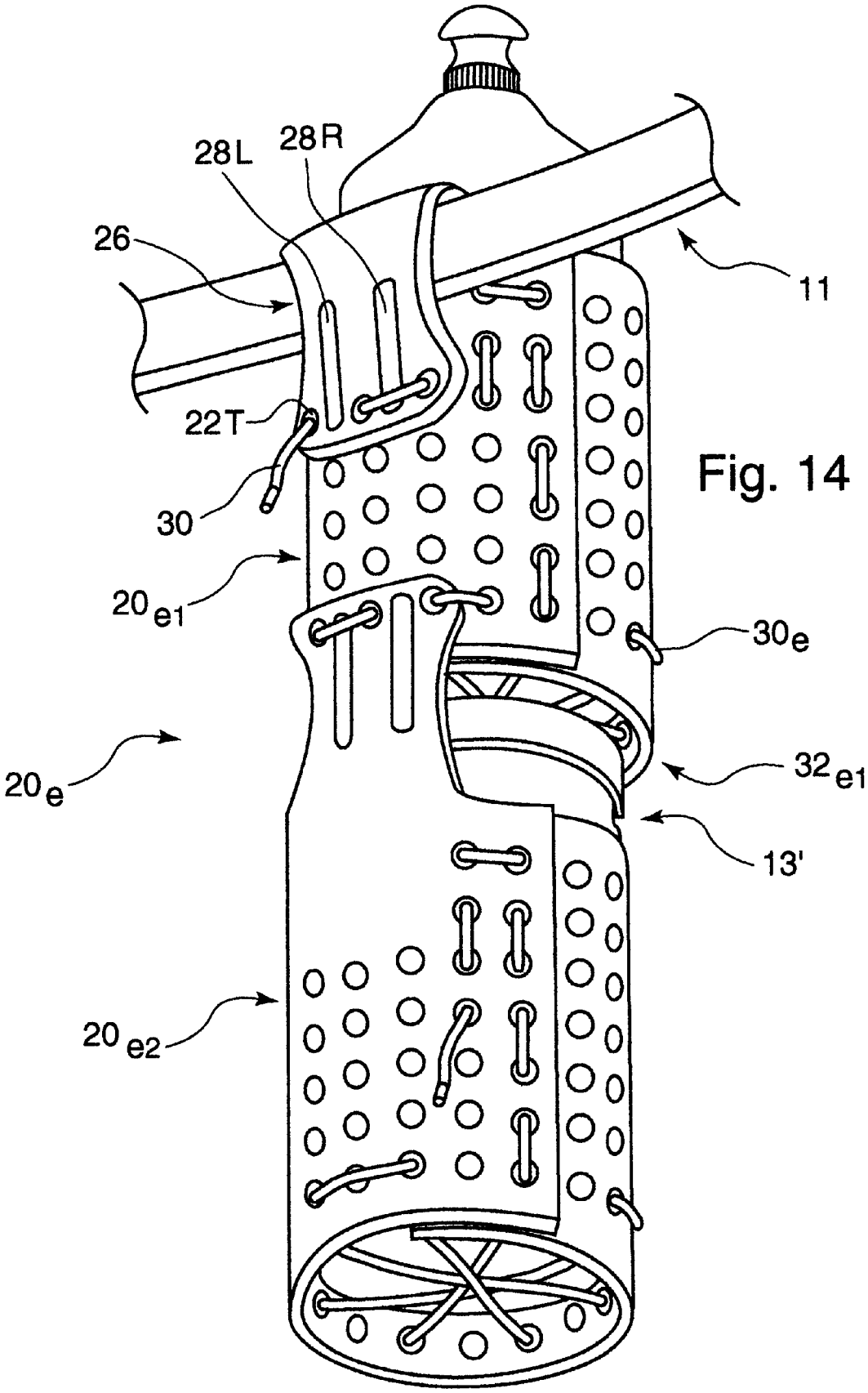

The material from which sheet 20' is made is preferably leather. Additional materials from which sheet 20' could be made include plastic and canvas. It will be understood that if canvas is chosen as the material of choice, holes 22 will preferably be reinforced with metal or plastic eyelets (not shown). An integral tab 26 is formed along a portion of upper edge 24U of sheet 20'. Tab 26 has a pair of slots 28R and 28L formed therein as well as holes 22T. Slots 28R and 28L could receive a belt or shoulder strap (not shown). Alternatively, tab 26 can be folded over to create a belt loop and holes 22T used to secure tab 26 in this position using a second portion of strand 30. In this latter case, slots 28R and 28L serve as relief openings to provide tab 26 with desired flexibility. This belt loop can then receive a belt 11 (FIG. 14). An additional alternative is that the two outside holes 22T could be tied together to provide a vertical slot for a shoulder belt.

A bottom 32 can be formed in sleeve 20 by crisscrossing a second portion 30, of strand 30 through a set of holes 20L preferably on the same horizontal plane. Although the sleeve 20 will most typically assume a cylindrical shape, it will be understood that the use of second portion $\mathbf{30}_1$ can be used to deform sleeve 20 into an oblong shape by using another variation in the lacing of the strand 30. More normally, the shape of the object will be relied upon to deform the sleeve 20 into other than a cylinder.

Figure 4:
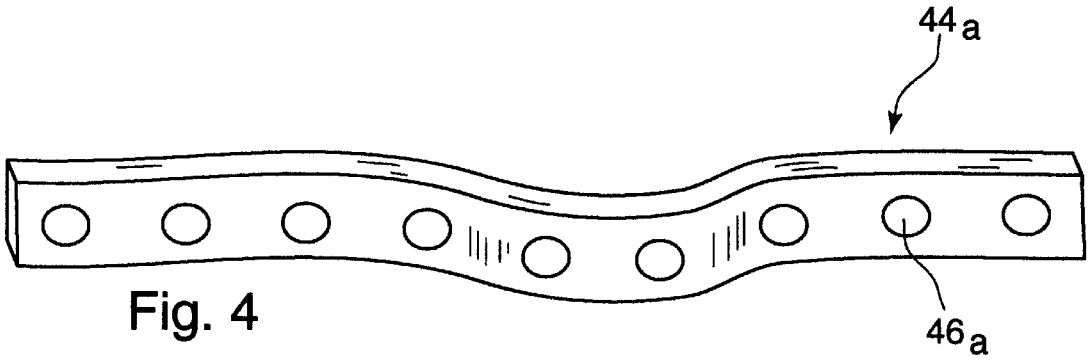
FIG. 4 is a perspective view of a perforated belt which can be used in a second embodiment of the present invention.
Figure 5:
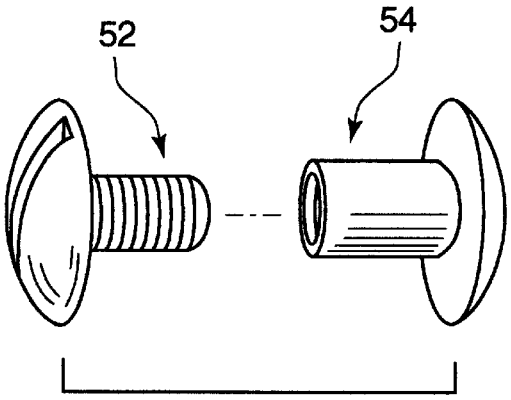
FIG. 5 is a perspective view of a two-piece rivet useful in attaching the perforated belt of FIG. 4.
Figure 6:
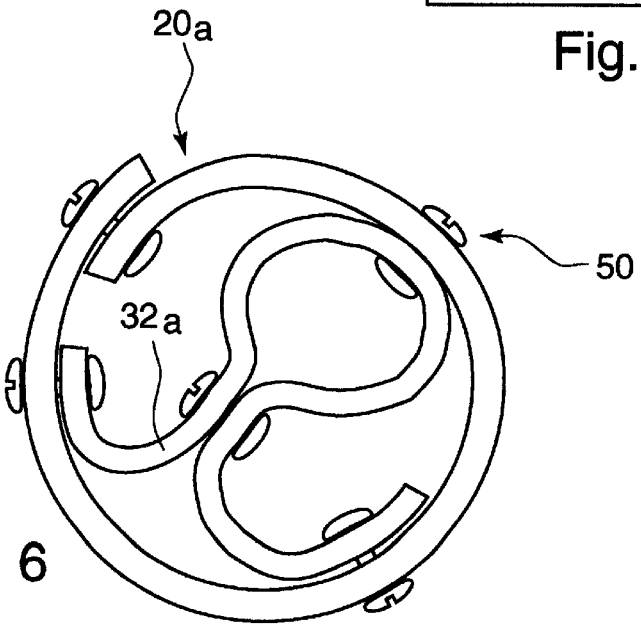
FIG. 6 is a bottom view of the second embodiment showing the perforated belt of FIG. 4 in its assembled position.

A second embodiment of the present invention is depicted in FIGS. 4–6. A separate strap 44*a* which has a plurality of holes 46*a* is used to form a bottom 32*a* in sleeve 20*a*. This large plurality of holes 46*a* provides flexibility in forming different size bottoms 32*a* for different size sleeves 20*a*. The strap 44*a* is secured to sleeve 20*a* and to itself using a two-piece rivet 50. Rivet 50 has an externally threaded stud 52 and an internally threaded nut 54 (FIG. 5).

Figure 7:
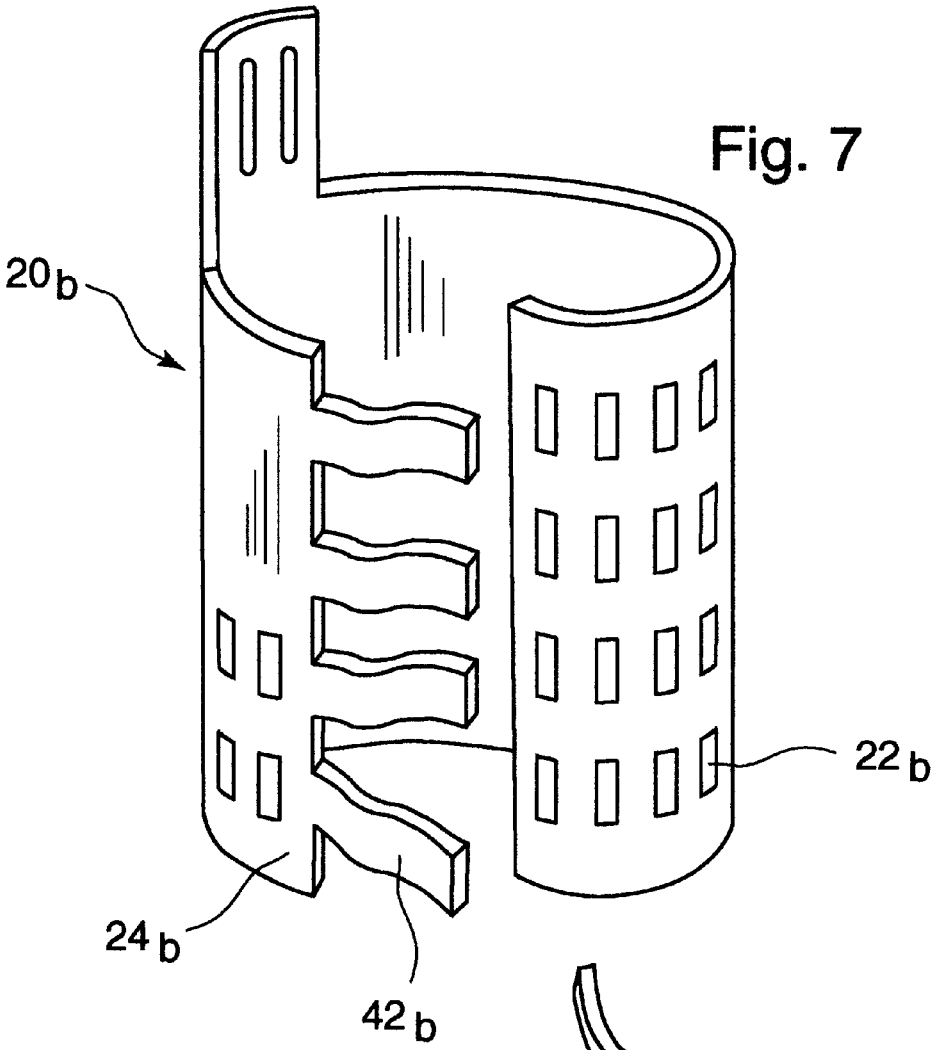
FIG. 7 is a perspective view of a third embodiment of the personal carrier of the present invention.
Figure 8:
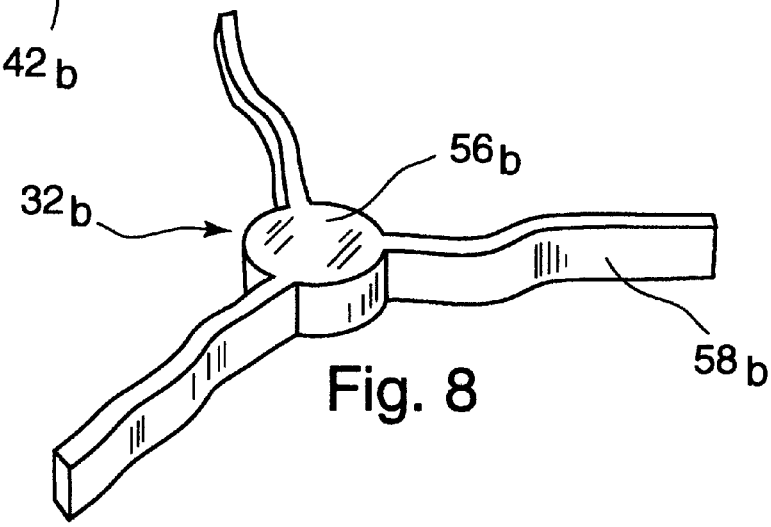
FIG. 8 is a perspective view of an alternative bottom member for the third embodiment.
Figure 9:
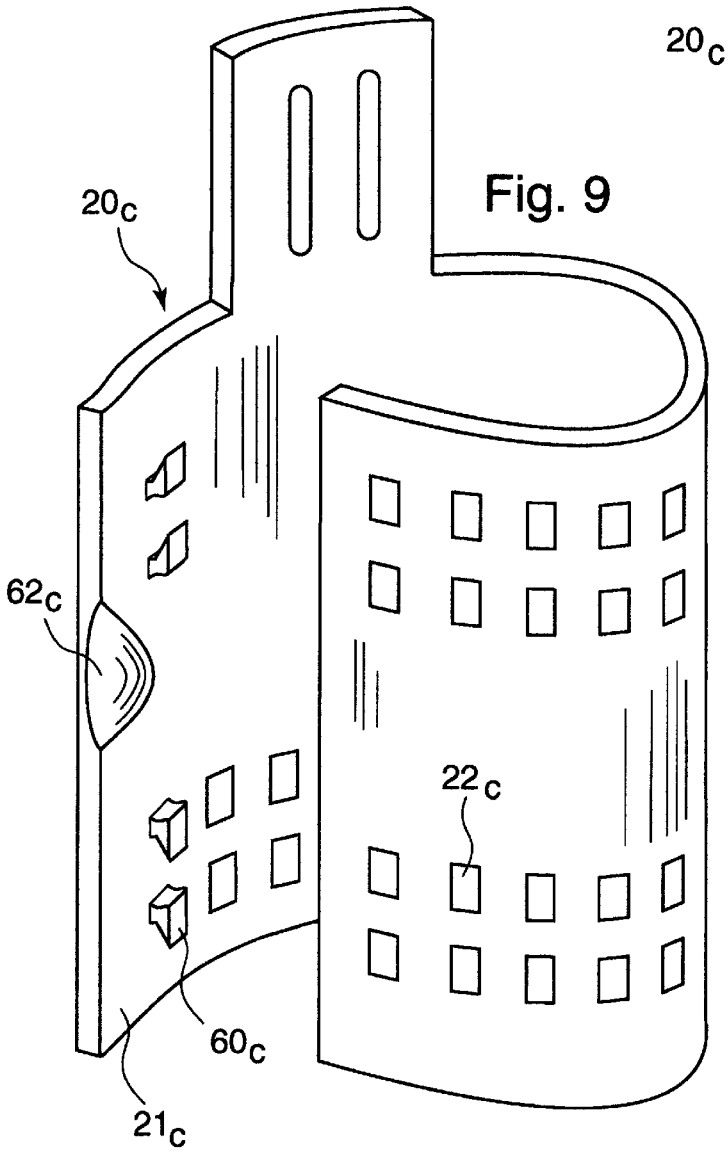
FIG. 9 is a perspective view of a fourth embodiment of the personal carrier of the present invention.

A third embodiment of the personal carrier 20*b* is depicted in FIGS. 7 and 8. In FIG. 7, the means for attaching the sleeve 20*b* in the desired configuration comprises a plurality of fingers 42*b* extending from a first side 24*b* of sheet which are received in complimentarily shaped holes 22*b*. There will be sufficient length of fingers 42*b* and tight enough tolerance on holes 22*b* to prevent the fingers 42*b* from inadvertently being withdrawn. Bottom member 32*b* (FIG. 8) comprises a center section 56*b* and a plurality of outwardly extending arms 58*b* which will interferingly fit in holes 22*b*. Obviously, as is the case with all the embodiments, for a shorter article, bottom member 32*b* can be inserted into a different horizontal row of holes 22*b* than the bottommost row. This will provide improved access to the upper region of the article.

Figure 10:
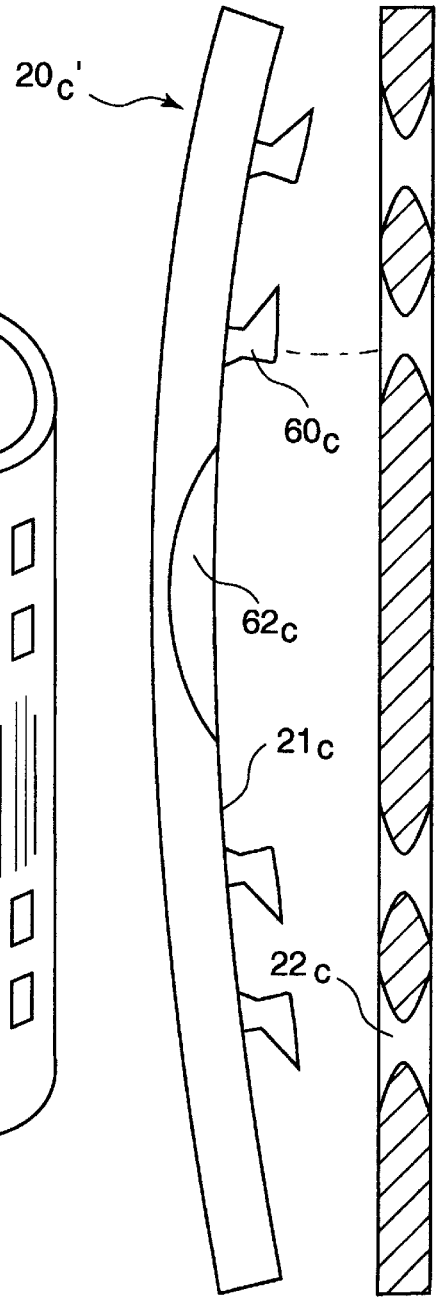
FIG. 10 is a side view of the fourth embodiment with parts cut away to depict its self-fastening feature.

A fourth embodiment 20*c* of the personal carrier is depicted in FIGS. 9–12. Inner face 21*c* of sheet 20*c*' is formed with a plurality of nubs 60*c* which are received in complimentarily shaped holes 22*c* (FIG. 10). Sheet 20*c*' can be flexed as shown in FIG. 10 and when sprung back to its planar configuration, nubs 60*c* will lock into holes 22*c*. Relief recess 62*c* can be utilized to enable the user's finger to reverse the process, engaging beneath inner face 21*c* flexing sheet 20*c*' outward in the middle to disengage nubs 60*c* from holes 22*c* to allow a new configuration of sleeve 20*c* to be formed.

Figure 11:
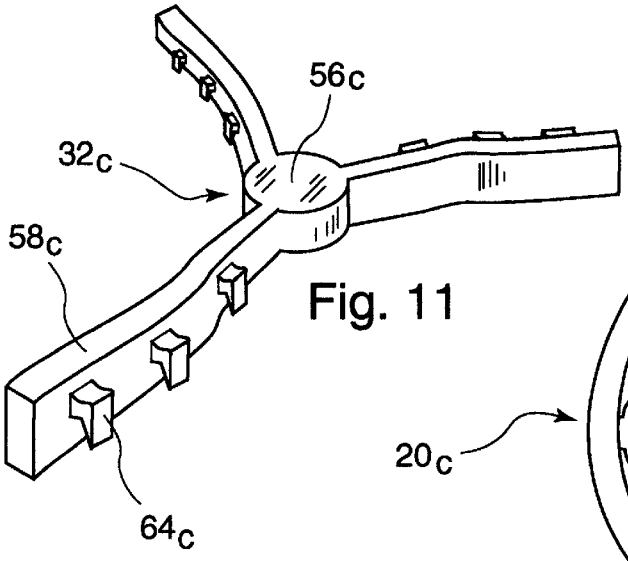
FIG. 11 is a perspective view of a fourth embodiment of bottom member for the personal carrier of the present invention.
Figure 12:
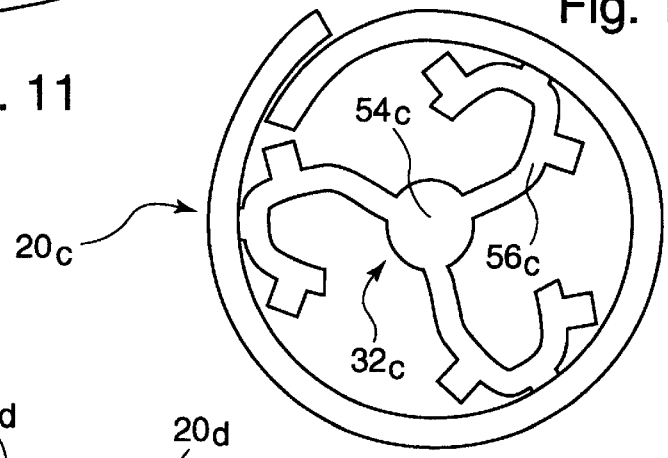
FIG. 12 is a bottom view of the personal carrier of the fourth embodiment showing the bottom engaged in the assembled carrier.

As seen in FIGS. 11 and 12, bottom member 32*c* comprises a center section 56*c* has a plurality of outwardly extending arms 58*c* each with a plurality of nubs 64*c* which are received through holes 22*c* (FIG. 10) in the opposite direction as nubs 60*c* (inside out rather than outside in). Holes 22*c* are tapered out in each lateral direction from a center minimum dimension to accommodate both sets of nubs 60*c* and 64*c*.

Figure 13:
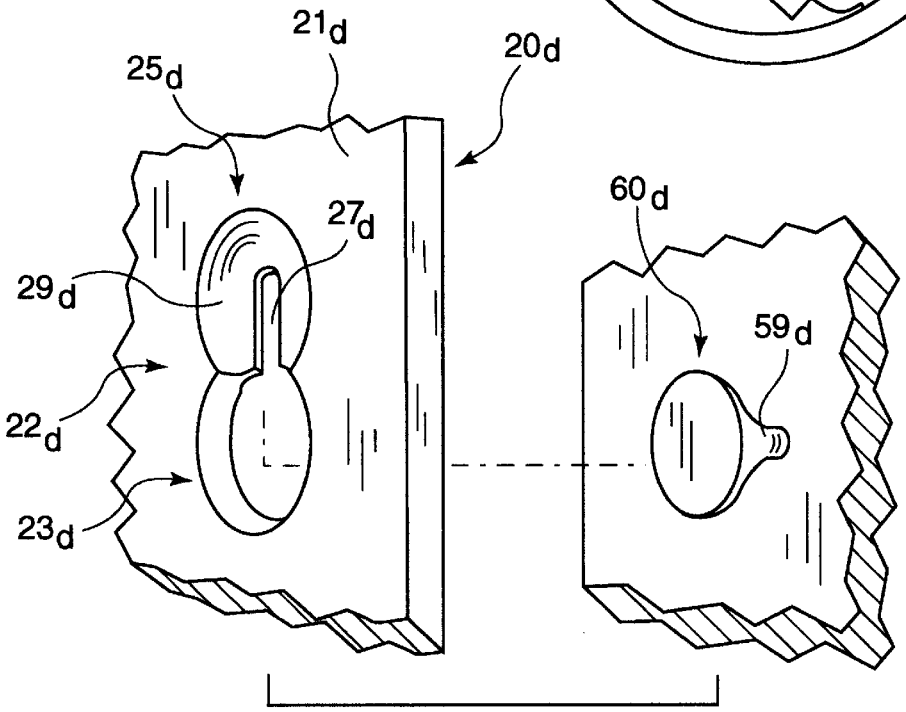
FIG. 13 is a perspective of a breakaway showing yet a fifth embodiment of personal carrier; and, FIG. 14 is a perspective view of an extended carrier formed by interconnecting two sleeves.

A fifth embodiment of the personal carrier of the present invention is shown in FIG. 13 generally at 20*d*. Nubs 60*d* are configured as buttons. Holes 22*d* are figure-8 shaped, the lower leg 23*d* of the figure-8 being a through bore and connected to the upper leg 25*d* by a slot 27*d*. The arm 59*d* of button 60*d* will slide in slot 27*d* permitting button 60*d* to be seated in recess 29*d*. Recess 29*d* has sufficient depth to allow button 60*d* to be flush with surface 21*d* of sleeve 20*d*. Although FIG. 13 depicts buttons 60*d* sliding upward in slot 27*d*, it will be understood that the figure-8 shaped holes 22*d* could be reoriented to permit the sliding to be downwardly or laterally.

FIG. 14 depicts a fifth embodiment of the personal carrier of the present invention generally at 20*e*. In this embodiment, a second sleeve $\mathbf{20}e_2$ is suspended from the bottom of sleeve $\mathbf{20}e_1$. While FIG. 14 depicts a second article 13' being suspended in sleeve $\mathbf{20}e_2$, it is also possible that the bottom $\mathbf{32}e_1$ could be omitted in order to accommodate longer articles. In such a case, strand 30*e* could be used to secure the front side of sleeve $\mathbf{20}e_2$ to the lower portion of sleeve $\mathbf{20}e_1$ since intermediate access will not be necessary.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A personal carrier for supporting an article comprising:

a) a generally rectangular sheet perforated by a first plurality of holes configured in a plurality of vertical columns permitting said sheet to be wrapped into any one of a plurality of different sized sleeves;

b) attachment means extending through a second plurality of said holes lying in at least a first one of said vertical columns adjacent a first edge of said generally rectangular sheet and through a third plurality of said holes lying in at least a second vertical column adjacent a second opposing edge, said at least a first one of said vertical columns overlying said at least a second vertical column to secure said sheet in said one of said plurality of different sized sleeves; and c) means to secure said one of said plurality of different sized sleeves to a body portion of a person.

2. The personal carrier of claim 1 wherein said generally rectangular sheet is made from a group of materials consisting of leather, canvas and plastic.

3. The personal carrier of claim 1 wherein said attachment means comprises a plurality of straps made integral with a first edge of said generally rectangular sheet.

4. The personal carrier of claim 1 wherein said attachment means comprises plurality of two-piece rivets.

5. The personal carrier of claim 1 further comprising means to form an extension for elongated articles including means for interconnecting a second sleeve to a distal end of said one of a plurality of sleeves.

6. The personal carrier of claim 1 wherein said means to secure said one of said plurality of different sized sleeves to a body portion comprises an integral tab extending from a top edge portion of said generally rectangular sheet, said tab having a pair of slots for receiving a belt-like strap.

7. The personal carrier of claim 6 further comprising additional holes in said integral tab adjacent an upper edge permitting said integral tab to be bent over and laced in a downward position to create a belt-receiving slot.

8. The personal carrier of claim 1 wherein said attachment means comprises a plurality of shaped nubs attached to an inner surface of said generally rectangular sheet, said plurality of shaped nubs being positionable in a like number of said first plurality of holes.

9. The personal carrier of claim 8 wherein each of said plurality of shaped nubs comprises a generally disk-shaped button and each of said first plurality of holes comprises a generally figure-8 shaped opening, a first cusp of said figure-8 shaped opening being a through hole and a second cusp of said figure-8 shaped hole being a recess in an outer surface of said generally rectangular shaped sheet, said recess having a depth generally equal to a thickness of said disk-shaped button.

10. The personal carrier of claim 8, wherein a portion of said plurality of shaped nubs are biased in a first direction and a second portion of said plurality of shaped nubs are biased in a second opposite direction and said plurality of nubs biased in said first direction are inserted into said like plurality of said first plurality of holes by flexing said generally rectangular sheet out of plane.

11. The personal carrier of claim 10 further comprising a relief recess enabling a person to insert a finger between secured layers of said generally rectangular sheet to disengage said plurality of shaped nubs from said like number of said first plurality of said holes to enable said first of said plurality of different sized sleeves to be reconfigured as a second of said plurality of different sized sleeves.

12. The personal carrier of claim 1 wherein said attachment means comprises a first portion of a strand which is woven through stacked pairs of said second and third pluralities of overlying holes.

13. The personal carrier of claim 12 wherein said strand comprises a length of lacing material selected from the group consisting of plastic, nylon, cotton, leather and blends thereof.

14. The personal carrier of claim 13 further comprising means to form a bottom in said one of said plurality of different sized sleeves.

15. The personal carrier of claim 14 wherein said means to form a bottom comprises a second portion of said strand woven through a fourth plurality of said first plurality of holes occupying a common horizontal row.

16. The personal carrier of claim 14 wherein said means to form a bottom comprises a separate member and means to secure said separate member to said one of said plurality of different sized sleeves.

17. The personal carrier of claim 16 wherein said means to secure said separate member comprises a plurality of two-piece rivets.

18. The personal carrier of claim 16 wherein said separate member comprises a perforated belt of a given length.

19. The personal carrier of claim 18 wherein said means to secure said separate member comprises a plurality of arms extending from a central portion, each of said plurality of arms having a portion which is insertable in one of said plurality of holes in said generally rectangular sheet.

20. The personal carrier of claim 1 wherein said portion which is insertable comprising a plurality of nubs positioned on each of said arms, each of said plurality of nubs being engageable with any of said plurality of holes.

* * * * *